US007297854B2

(12) United States Patent
Nishida

(10) Patent No.: US 7,297,854 B2
(45) Date of Patent: Nov. 20, 2007

(54) KEYBOARD APPARATUS

(75) Inventor: Kenichi Nishida, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/488,975

(22) Filed: Jul. 18, 2006

(65) Prior Publication Data

US 2007/0017339 A1 Jan. 25, 2007

(30) Foreign Application Priority Data

Jul. 21, 2005 (JP) ..... 2005-211509
Jun. 5, 2006 (JP) ..... 2006-156174

(51) Int. Cl.
*G10C 3/12* (2006.01)

(52) U.S. Cl. ..... 84/423 R

(58) Field of Classification Search ..... 84/423 R, 84/477, 478, 430, 441, 423 A
See application file for complete search history.

(56) References Cited

U.S. PATENT DOCUMENTS 4,205,583 A 6/1980 Absmann
4,308,783 A 1/1982 Absmann
5,796,023 A * 8/1998 Kumano et al. ..... 84/433
6,156,963 A 12/2000 Masubuchi et al.

FOREIGN PATENT DOCUMENTS

JP 60-052439 3/1985
JP 10-240228 9/1998
JP 3060938 4/2000

* cited by examiner

*Primary Examiner*—Kimberly Lockett
(74) *Attorney, Agent, or Firm*—Morrison & Foerster LLP

(57) ABSTRACT

A keyboard apparatus having a construction which can maintain an excellent balance in touch feeling between white keys and black keys and can be made compact in size in the longitudinal direction. The driven part of each of mass bodies associated with respective white keys and the driven part of each of mass bodies associated with respective black keys are at the same longitudinal location, and at the same time the distance between the driven part of each black key-associated mass body and a pivotal motion support associated therewith is longer than the distance between the driven part of each white key-associated mass body and a pivotal motion support associated therewith.

8 Claims, 8 Drawing Sheets

KEYBOARD APPARATUS

BACKGROUND OF THE INVENTION

1. Field of the Invention

The present invention relates to a keyboard apparatus provided with pivotal members that each perform pivotal motion in accordance with a key depressing operation.

2. Description of the Related Art

In a keyboard apparatus with a keyboard of a translation type in which each key is vertically translated, it is easy to make uniform the key depression stroke and touch weight of each white key and those of each black key. However, in a keyboard apparatus configured such that each key is pivotally moved about its key pivot in the vertical direction, the distance between a portion of the key operated for key depression and the key pivot is shorter in black keys than in white keys, so that it is difficult to secure a sufficient key depression stroke for each black key without special design, and the tough weight of each black key tends to increase.

To overcome this problem, a keyboard apparatus has been proposed in which the key pivot of the black key is located rearward of that of the white key so as to keep the touch feeling of the white key and that of the black key in a somewhat more balanced state (see Japanese Laid-Open Patent Publication (Kokai) No. S60-52439).

On the other hand, keyboard apparatuses are also known in which mass bodies are mounted on a key frame or the like in a manner pivotally movable about respective pivotal motion supports, each for applying an appropriate inertial force to the associated key when the key is depressed. In a keyboard apparatus of this type, in general, when a key is depressed, a driven part of the associated mass body is driven by a driving part of the key, whereby the mass body is pivoted in accordance with the key depression.

Further, this type of keyboard apparatus provided with the mass bodies is configured, for example, such that the pivotal motion supports for all the mass bodies associated with the respective black and white keys are arranged at the same longitudinal (front-rear) location, whereas the driven part of the mass body for each black key is located forward of that of the mass body for each white key. That is, the principle of leverage is utilized to secure an appropriate key depression stroke of the black key and at the same time minimize the difference between the touch feeling of the white key and that of the black key.

However, since the driven part of the mass body for each black key is located forward of that of the mass body for each white key as described above, the length of the mass body for the black key becomes longer, and hence the space of a portion in the longitudinal direction of the keyboard apparatus where the mass bodies are to be arranged is reduced.

For keyboard apparatuses, there have been proposed various configurations of the pivotal motion support for pivotally supporting a pivotal member (a key, a mass body, or the like) which performs pivotal motion in accordance with key depression. Particularly, one of the configurations is characterized in that the pivotal motion supports are provided on ribs extending in the vertical and longitudinal directions. Further, some pivotal motion-supports are configured such that the ribs are integrally formed with a resin-made key frame by injection molding using a mold.

In this case, ribs provided for keys adjacent to each other are very close to each other, and further each rib is in the form of a flat plate. This brings about the problem that the thickness of projections and the like of the mold, for forming the respective ribs, is inevitably required to be reduced, which reduces the strength of the mold.

SUMMARY OF THE INVENTION

It is a first object of the present invention to provide a keyboard apparatus which can maintain an excellent balance in touch feeling between white keys and black keys and can be made compact in size in the longitudinal direction.

It is a second object of the present invention to provide a keyboard apparatus which can maintain an excellent balance in touch feeling between white keys and black keys and easily realize key scaling of the key-touch weight (i.e. progressive variation of the key-touch weight according to the tone pitch).

It is a third object of the present invention to provide a keyboard apparatus which can reduce the number of thin-wall portions of a mold for injection molding of a support member and enhance the strength of the mold.

To attain the above object, in a first aspect of the present invention, there is provided a keyboard apparatus comprising a support member, a plurality of keys each having a driving part, and disposed on the support member such that each key is pivotally movable about a base end part thereof, the keys comprising a plurality of white keys and a plurality of black keys, a plurality of pivotal motion supports fixedly provided on the support member, and a plurality of mass bodies provided in a manner respectively associated with the pivotal motion supports, and each having a driven part, the mass bodies being disposed in a manner pivotally movable about respective associated ones of the pivotal motion supports, and comprising white key-associated mass bodies that are associated with the white keys, respectively, and black key-associated mass bodies that are associated with the black keys, respectively, wherein the driving part of each key drives the driven part of an associated one of the mass bodies, in accordance with pivotal motion of the key, whereby the associated mass body pivotally moves about the associated pivotal motion support, and wherein the driven part of each white key-associated mass body and the driven part of each black key-associated mass body are at the same longitudinal location, and at the same time a distance between the driven part of the black key-associated mass body and the pivotal motion support associated therewith is longer than a distance between the driven part of the white key-associated mass body and the pivotal motion support associated therewith.

With the arrangement of the first aspect of the present invention, it is possible to maintain an excellent balance in touch feeling between the white keys and the black keys and make the apparatus compact in size in the longitudinal direction.

Preferably, the keyboard apparatus comprises pivotal motion range-limiting parts for limiting a range of pivotal motion of each of the mass bodies, and a distance through which a free end of each mass body moves in accordance with the pivotal motion of the mass body is made substantially equal between the white key-associated mass bodies and the black key-associated mass bodies.

With the arrangement of this preferred embodiment, it is possible to make touch weight balanced between white keys and black keys to thereby cause the touch feeling to match between the white keys and the black keys.

To attain the above object, in a second aspect of the present invention, there is provided a keyboard apparatus comprising a support member, a plurality of keys each having a driving part, and disposed on the support member such that each key is pivotally movable about a base end part thereof, the keys comprising a plurality of white keys and a plurality of black keys, a plurality of pivotal motion supports fixedly provided on the support member, and a plurality of mass bodies provided in a manner respectively associated with the pivotal motion supports, and each having a driven part, the mass bodies being disposed in a manner pivotally movable about respective associated ones of the pivotal motion supports, and comprising white key-associated mass bodies that are associated with the white keys, respectively, and black key-associated mass bodies that are associated with the black keys, respectively, wherein the driving part of each key drives the driven part of an associated one of the mass bodies, in accordance with pivotal motion of the key, whereby the associated mass body pivotally moves about the associated pivotal motion support, wherein the pivotal motion support of each of the mass bodies is located toward one side in the longitudinal direction with respect to the driven part, wherein the pivotal motion support is disposed toward the one side in the longitudinal direction, for the black key-associated mass bodies than for the white key-associated mass bodies, and wherein as to each of the white key-associated mass bodies and the black key-associated mass bodies, the pivotal motion support of the mass body is located more toward the one side in the longitudinal direction as the mass body is of a key for a higher pitch tone, such that touch feeling of the key becomes progressively lighter from a lower pitch tone side to a higher pitch tone side.

With the arrangement of the second aspect of the present invention, it is possible to maintain an excellent balance in touch feeling between the white keys and the black keys and easily realize proper key scaling of the touch weight.

Preferably, the keyboard apparatus comprises pivotal motion range-limiting parts for limiting a range of pivotal motion of each of the mass bodies, and the pivotal motion range-limiting parts limit the range of pivotal motion of each of the white key-associated mass bodies and the black key-associated mass bodies, such that a distance through which a free end of each mass body moves in accordance with the pivotal motion of the mass body is made smaller for the mass body on a higher pitch tone side.

With the arrangement of this preferred embodiment, it is possible to make uniform the key depression strokes of the respective white keys and those of the respective black keys, to thereby improve the key scaling of the touch weight.

To attain the above object, in a third aspect of the present invention, there is provided a keyboard apparatus comprising a support member made of a resin, a plurality of support providing parts formed integrally with the support member and having a rib-like shape extending in a longitudinal direction and a vertical direction, a plurality of pivotal motion supports associated with the support providing parts, respectively, and each fixedly arranged at respective associated ones of the support providing parts, and a plurality of rotary members disposed in a manner associated with the pivotal motion supports, respectively, each for pivotally moving about an associated one of the pivotal motion supports in accordance with key depressing operation, wherein the support providing part associated with each rotary member and the support providing part associated with one of the rotary members adjacent to the rotary member at least on one of left and right sides thereof are disposed at different locations in the longitudinal direction.

With the arrangement of the third aspect of the present invention, it is possible to reduce the number of thin-wall portions of a mold for injection molding of the support member, thereby enhancing the strength of the mold.

Preferably, the pivotal motion support associated with each rotary member, and the pivotal motion support associated with one of the rotary members adjacent to the rotary member at least on one of left and right sides thereof are disposed at different locations in the longitudinal direction.

With the arrangement of this preferred embodiment, it is possible to make it easy to avoid interference between pivotal motion supports in the transverse (left-right) direction, thereby enhancing the degree of freedom of design of the pivotal motion supports.

Preferably, the rotary members each have a driven part, and are a plurality of mass bodies comprising white key-associated mass bodies that each pivotally move in accordance with a key depressing operation of an associated white key and black key-associated mass bodies that each pivotally move in accordance with a key depressing operation of an associated black key, the driven part of each mass body being configured to perform pivotal motion in accordance with driving of the driven part by the associated key, and the pivotal motion support of each mass body is located on one side of the driven part in the longitudinal direction, and the pivotal motion supports respectively associated with the black key-associated mass bodies are located more toward the one side in the longitudinal direction than the pivotal motion support respectively associated with the white key-associated mass bodies.

With the arrangement of this preferred embodiment, it is possible to maintain an excellent balance in touch feeling between the white keys and the black keys and make the apparatus compact in size in the longitudinal direction.

Preferably, the rotary members each have a driven part, and are a plurality of mass bodies comprising white key-associated mass bodies that each pivotally move in accordance with a key depressing operation of an associated white key and black key-associated mass bodies that each pivotally move in accordance with a key depressing operation of an associated black key, the driven part of each mass body being configured to perform pivotal motion in accordance with driving of the driven part by the associated key, and the support providing parts associated with respective white key-associated mass bodies are different in longitudinal location from the support providing parts associated with the respective black key-associated mass bodies, respectively.

With the arrangement of this preferred embodiment, it is possible to reduce thin wall parts of a mold for forming the support member having the support providing parts associated with the respective mass bodies, to thereby increase the strength of the mold.

The above and other objects, features, and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
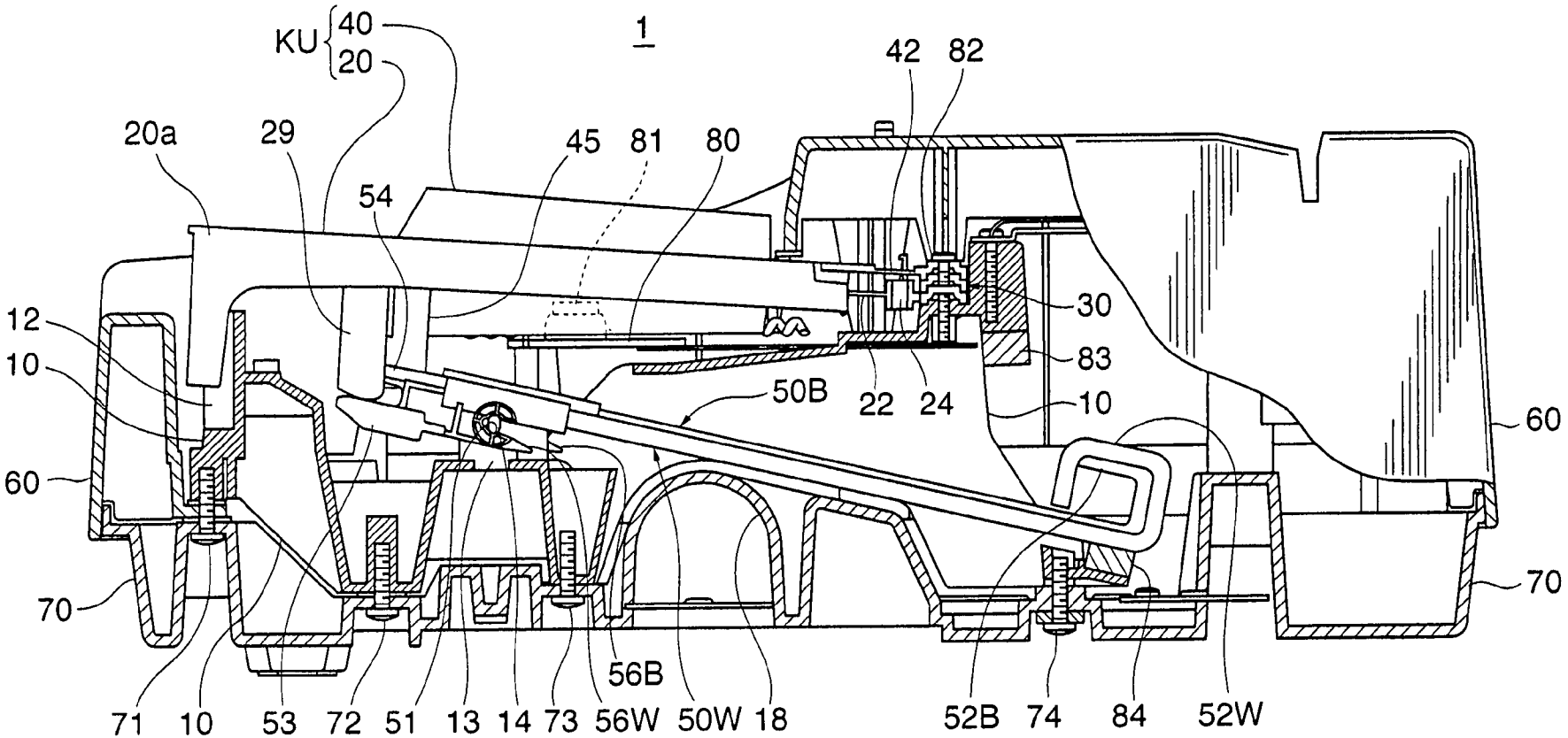
FIG. 1 is a longitudinal cross-sectional view of a keyboard apparatus according to a first embodiment of the present invention.

FIG. 1 is a longitudinal cross-sectional view of a keyboard apparatus according to a first embodiment of the present invention. This keyboard apparatus 1 is configured as an electronic keyboard instrument. In the following, a player's side (left side, as viewed in FIG. 1) of the keyboard apparatus 1 will be referred to as the "front" side.

As shown in FIG. 1, the keyboard apparatus 1 has a key frame 10 disposed in a casing formed by an upper case 60 and a lower case 70. In the key frame 10, there are arranged a plurality of key units KU each comprised of a plurality of white keys 20 and a plurality of black keys 40. Each of the key units KU has a common base end part 30 rigidly secured to the key frame 10, and the keys 20 and the black keys 40 are each arranged such that a free end part thereof can vertically pivot (or swing).

The key frame 10 is fastened to the lower case 70 by a plurality of screws 72, 73, and 74. Further, the lower case 70, the upper case 60, and the key frame 10 have respective front parts thereof fastened together by a plurality of bolts 71. The lower case 70 and the upper case 60 have respective rear parts thereof fastened to each other by screwing a plurality of screws, not shown, into respective suitable portions of the lower case 70 and the upper case 60. The lower case 70 has a lower part thereof formed with a recess 18 e.g. for accommodating batteries.

Hereafter, component elements of the keyboard apparatus 1 which are of the same kind and provided in association with the white keys 20 and the black keys 40 are each designated by the same reference numeral, but when it is required to distinguish between the association with a white key 20 and that with a black key 40, the associated component elements of the same kind are distinguished from each other by adding "W" and "B" to the respective reference numerals.

Mass bodies 50 (50W and 50B) are arranged in the frame 10 in association with the white keys 20 and the black keys 40, respectively. Each of the mass bodies 50W and 50B is supported by an associated bearing 51 such that it can vertically pivot about a pivot 14 (14W or 14B; described hereinafter with reference to FIG. 5) disposed on mass body-supporting ribs 13 (13W or 13B; described hereinafter with reference to FIGS. 4 and 5) integrally formed with the key frame 10. Almost all mass of each mass body 50 (50W or 50B) is concentrated on a rear end part 52 (52W or 52B) of the mass body 50 (50W or 50B). The mass body 50 performs a pivotal motion in a manner interlocked with the associated key, whereby an appropriate inertia force is applied to the key to realize such a key touch as obtained from an acoustic piano.

An upper limit stopper 83 projects from an upper rear part of the key frame 10, and a lower limit stopper 84 projects from a lower rear part of the same. The upper limit stopper 83 and the lower limit stopper 84 may be provided in association with each key, but in the present embodiment, they are commonly provided for a plurality of keys (all the keys in the apparatus or all the keys in one key unit KU, for example). The rear end part 52 of the mass body 50 comes into abutment with the lower limit stopper 84, which defines a non-depressed position (initial position) of the mass body 50 and the associated key. On the other hand, the rear end part 52 of the mass body 50 comes into abutment with the upper limit stopper 83, which defines a depression end position (pivotal motion end position) of the mass body 50 and the associated key.

Further, key-on switches 81 are arranged on a circuit board 80 disposed on the key frame 10, in association with the respective white and black keys 20 and 40. Each of these key-on switches 81 detects depression of an associated one of the keys. A tone generator, not shown, generates musical tones based on results of detection by the key-on switches 81.

Further, a front part of the key frame 10 is formed with key guide parts 12 each for guiding the associated key being operated for depression. The key guide parts 12 are formed in association with the respective white keys 20. Each of the white keys 20 has a front end 20*a* formed with a guided part 33 (see FIG. 2) for engagement with an associated one of the key guide parts 12, such that the engagement between the guided part 33 and the key guide part 12 restricts transverse movement of the front end 20*a* of the white key 20 and properly guides the same for proper vertical motion.

Though not shown in detail, one key unit KU is comprised of two white key units and one black key unit whose base end parts are laminated. Although the one key unit KU is formed as a one-octave unit, this is not limitative. The white keys 20 of the key unit KU are formed by connecting white key bodies to the common base end part 30 via respective vertical hinge parts 24 and respective horizontal hinges 22, each in the form of a thin plate. The black keys 40 of the key unit KU are formed by connecting black key bodies to the based end part 30 via respective horizontal hinges 42 each in the form of a thin plate. The common based end part 30 is fastened to the key frame 10 by screws 82.

The vertical hinge parts 24 permit the swinging motion of the white key 20 in the direction of arrangement of the keys (transverse or left-right direction), but the engagement between the key guide 12 and the guided part 33 properly restricts the position of the free end of the white key 20. Further, the vertical bending of the horizontal hinge 22 makes the free end of the white key 20 pivotable in a key depression/release direction (vertical direction). Further, similarly to the horizontal hinge 22, the vertical bending of the horizontal hinge 42 makes the free end of the black key 40 pivotable in the key depression/release direction. Strictly, the support for pivotal motion of the white key 20 is located at a connecting point PW between the vertical hinge part 24 and the horizontal hinge 22, and the support for pivotal motion of the black key 40 is located at a connecting point PB between the common base end part 30 and the horizontal hinge 42 (see FIG. 6). Further, the respective longitudinal centers of the horizontal hinges 22 are substantially the respective centers of pivotal motions of the white keys 20, and the respective longitudinal centers of the horizontal hinges 42 are substantially the respective centers of pivotal motions of the black keys 40.

Figure 2:
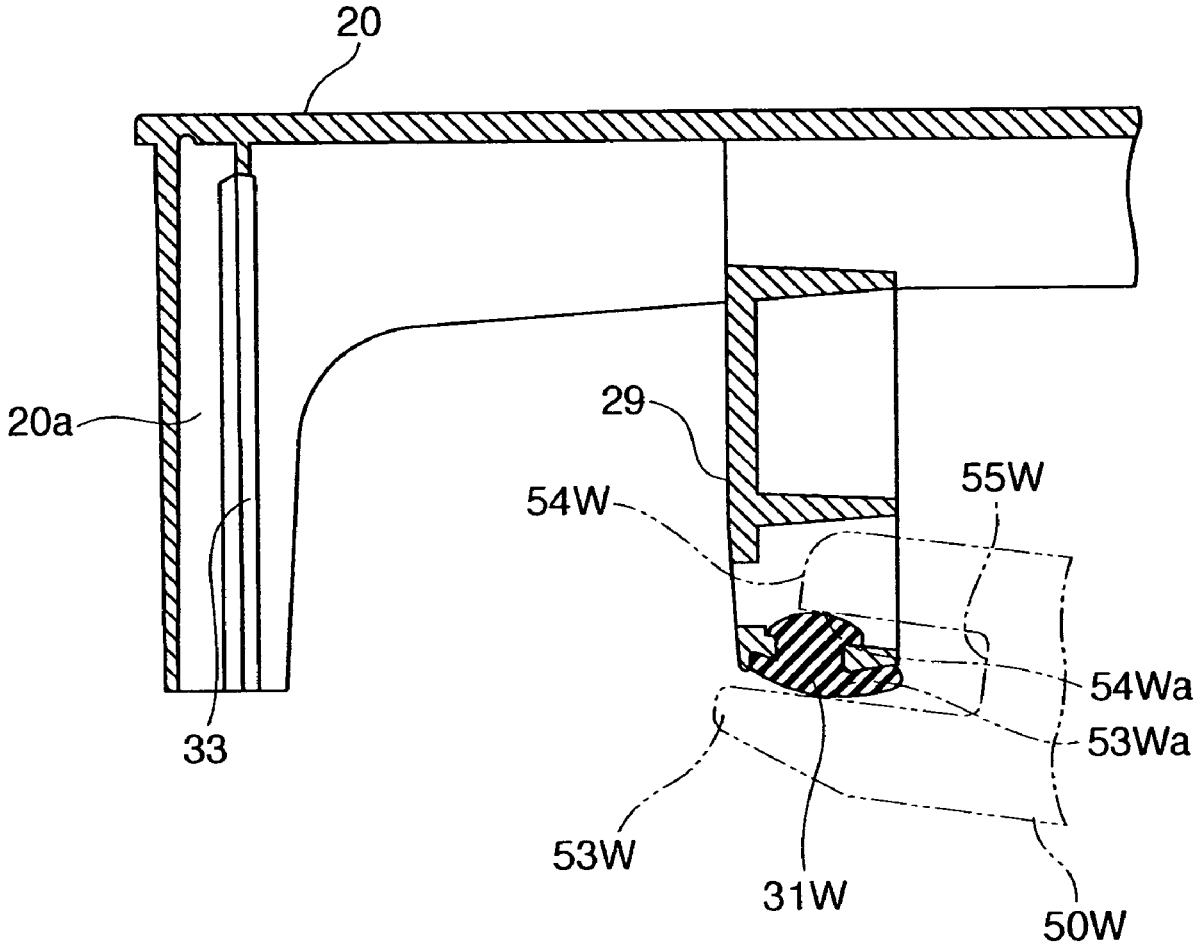
FIG. 2 is a cross-sectional view of a front half of a white key.
Figure 3:
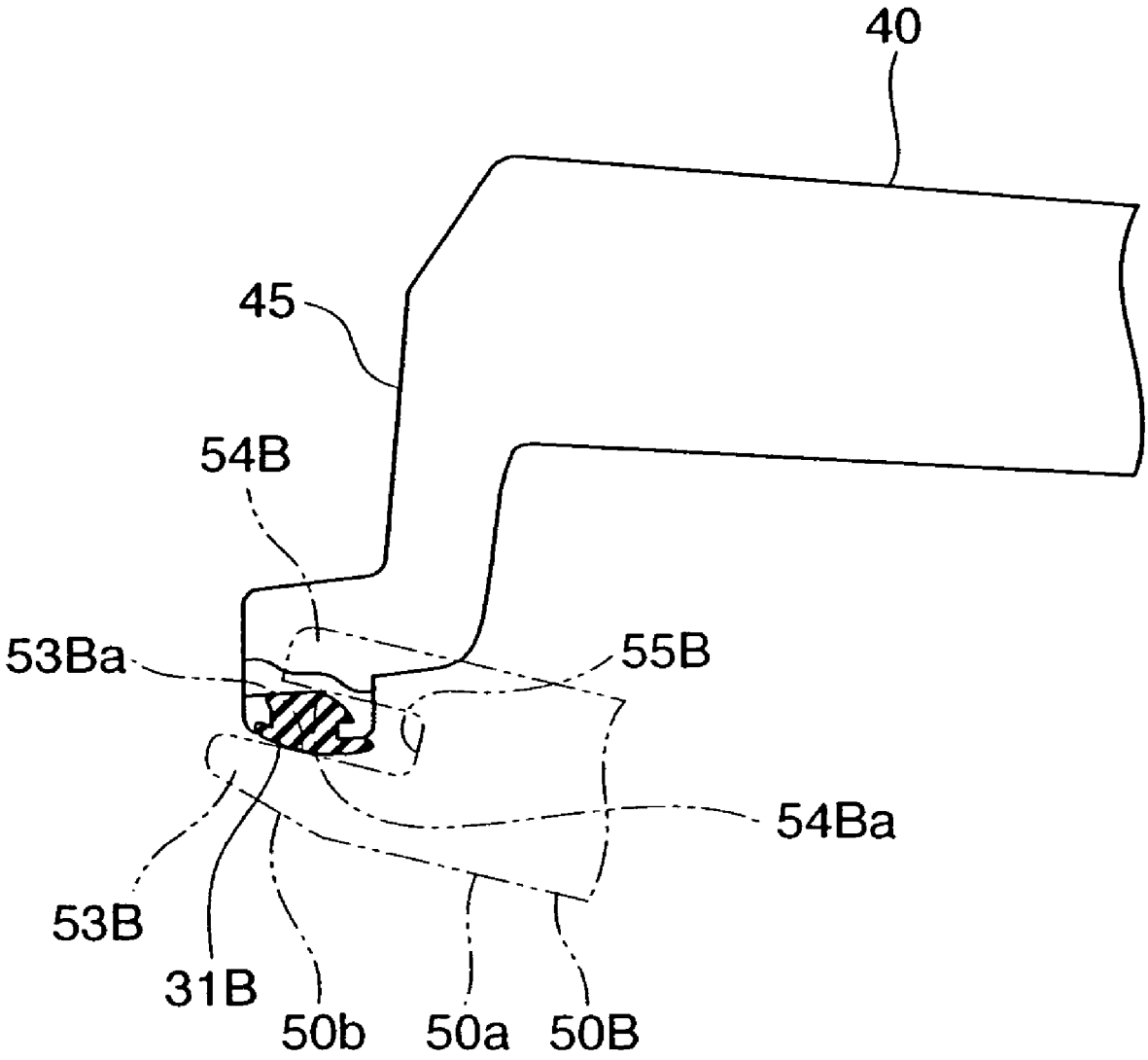
FIG. 3 is a side view, partly in cross section, of a front half of a black key.
Figure 4:
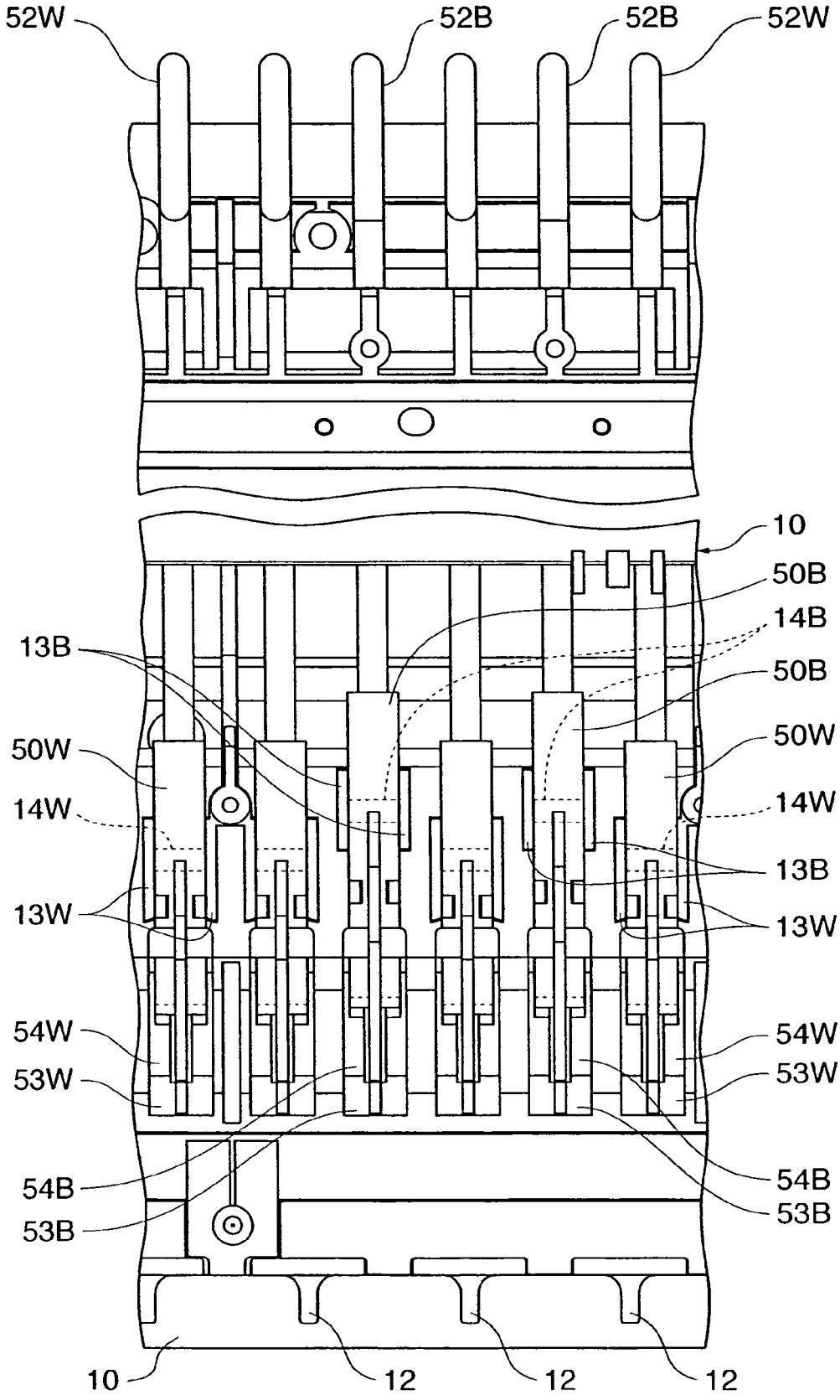
FIG. 4 is a fragmentary plan view of a key frame to which are assembled mass bodies.
Figure 5:
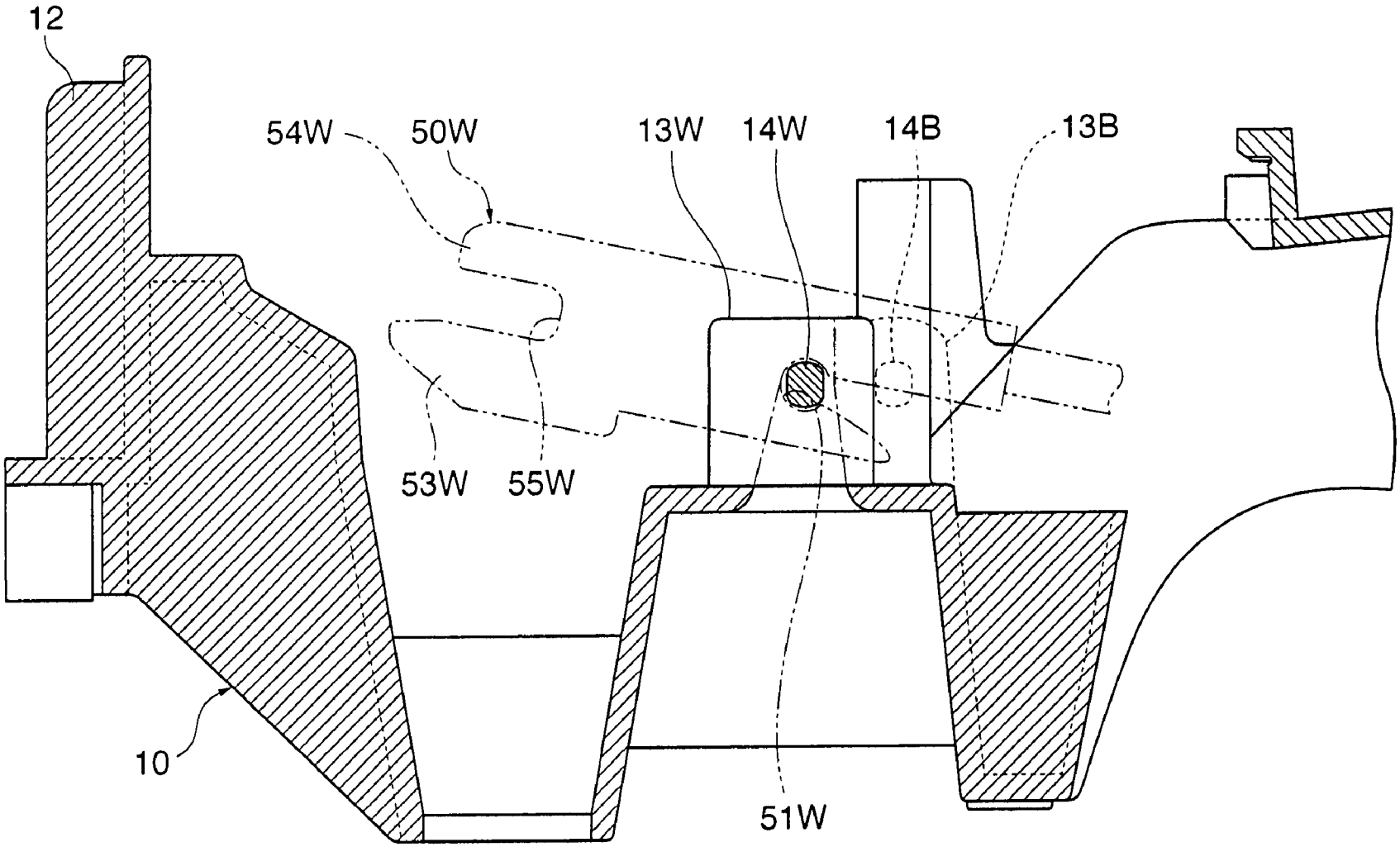
FIG. 5 is a cross-sectional view of a front half of the key frame.

FIG. 2 is a cross-sectional view of the front half of the white key 20. FIG. 3 is a side view, partly in cross section, of the front half of the black key 40. FIG. 4 is a fragmentary plan view of the key frame 10 to which are assembled the mass bodies 50. FIG. 5 is a cross-sectional view of the front half of the key frame 10.

As shown in FIGS. 4 and 5, the key frame 10 is formed with the aforementioned mass body-supporting ribs 13. The key frame 10 is made of resin, and is formed by injection molding using a mold. The mass body-supporting ribs 13 are integrally formed with the key frame 10 such that they extend from the upper surface of the key frame 10, in the longitudinal and vertical directions as thin plates. The mass body-supporting ribs 13W and 13B are provided in respective pairs in a manner associated with the white key 20 and the black key 40, respectively. All the mass body-supporting ribs 13W are disposed at the same longitudinal location. All the mass body-supporting ribs 13B are disposed at the same longitudinal location. The mass body-supporting ribs 13B are located rearward of the mass body-supporting ribs 13W, whereby the overlap between the two ribs 13B and 13W in the longitudinal direction is made small.

Further, the pivot 14W and the pivot 14B are suspended between each pair of mass body-supporting ribs 13W and between each pair of mass body-supporting ribs 13B, respectively. The pivot 14B is located rearward of the pivot 14W, and the two pivots 14W and 14B do not overlap in the longitudinal direction.

As shown in FIGS. 4 and 5, the foremost part of the key frame 10 has the aforementioned key guides 12 integrally formed therewith in association with the respective white keys 20 such that the key guides 12 extend vertically. On the other hand, as shown in FIG. 2, each white key 20 has the front end 20*a* thereof formed with the aforementioned guided part 33.

As shown in FIGS. 1 and 5, the bearings 51 (51W and 51B; 51B, not shown) of the mass bodies 50 open rearward. The bearings 51 are fitted on the pivots 14 from the open side thereof whereby the mass bodies 50W and 50B are made pivotable about the pivots 14W and 14B, respectively, as shown in FIG. 4. When the mass body 50 is in a free state in which it is freely pivotably arranged on the pivot 14 (without having the associated key disposed thereon), it has a rear end 52 thereof brought into contact with the lower limit stopper 84 (see FIG. 1) by its own weight, whereby the front end of the mass body 52 is in a lifted position, while the rear end 52 of the same is in a lowered position.

A tongue 56 (56W or 56B) extends rearward from the lower side of the bearing 51 of the mass body 50. The tongue 56 is made of a soft resin or the like and is flexible, and when the bearing 51 is fitted on the pivot 14, the tongue 56 serves as a guide. Further, the opening of the bearing 51 is narrower in the vicinity of the root of the tongue 56 than in the vicinity of the foremost end of the same, whereby the pivot 14 fitted on the bearing 51 is made difficult to fall off.

As shown in FIGS. 2 to 4, the respective foremost ends of the mass bodies 50W and 50B are formed with lower engaging pieces 53W and 53B and upper engaging pieces 54W and 54B which are members driven by the white key 20 and the black key 40, respectively, and the upper engaging pieces 54W and 54B and the lower engaging pieces 53W and 53B define respective fitting recesses 55W and 55B therebetween (see FIGS. 2 and 3).

Here, as to the longitudinal and vertical positional relationship between the upper engaging pieces 54W and 54B and the lower engaging pieces 53W and 53W, the upper engaging pieces 54W and 54B are at the same longitudinal and vertical location, while the lower engaging pieces 53W and 53W are at the same longitudinal and vertical position. By shifting the pivot 14B to a more rearward location than the pivot 14W, the distance between the lower engaging piece 53B and the pivot 14B is made larger than that between the lower engaging piece 53W and the pivot 14W (see FIG. 4). Assuming that the mass bodies 50 whose rear ends have the same mass each perform a single or separate pivotal motion, if the lower engaging pieces 53W and 53B are driven, the above arrangement causes the mass body 50B to be pivoted by a weaker driving force than the mass body 50W due to leverage.

As shown in FIG. 2, a hanging driving piece 29 is formed integrally with the bottom of the front part of the white key 20 such that the hanging driving piece 29 extends downward therefrom. The hanging driving piece 29 has a resilient member 31W, made of rubber or the like, secured to a lower end thereof, and the resilient member 31W (lower end thereof) serves as a driving part for directly driving the associated mass body 50W. That is, when the key unit KU has been properly assembled to the key frame 10, the resilient member 31W is in a state fitted in the fitting recess 55W to engage between the lower engaging piece 53W and the upper engaging piece 54W, so that it is always in contact with the upper surface 53Wa of the lower engaging piece 53 and the lower surface 54Wa of the upper engaging piece 54W.

For example, when a white key 20 is depressed, the resilient member 31W of the hanging driving piece 29 of the white key 20 drives the upper surface 53Wa of the lower engaging piece 53W of the associated mass body 50W, whereby the mass body 50W is pivoted in the key depressing direction (direction in which the front end of the mass body 50W moves downward) in a manner interlocked with the white key 20. On the other hand, when the key is released, the weight of the mass body 50W and the returning force produced by the resilience of the horizontal hinge 22 of the white key 20 causes the mass body 50W to pivot in the key release direction (direction in which the front end of the mass body 50W moves upward) together with the white key 20. Therefore, during performance operations, the white key 20 and the mass body 50W always perform respective pivotal motions in a manner interlocked with each other.

The construction of the front end of the mass body 50B and the engaging relationship between the black key 40 and the mass body 50B are the same as the construction of the front end of the mass body 50W and the engaging relationship between the white key 20 and the mass body 50W. More specifically, as shown in FIG. 3, a hanging driving piece 45 is integrally formed with the bottom of the front half of the black key 40 such that the hanging driving piece 45 extends downward therefrom (see also FIG. 1). The hanging driving piece 45 has a resilient member 31B secured to a lower end thereof, and the resilient member 31B is fitted in the fitting recess 55B to engage between the lower engaging piece 53B and the upper engaging piece 54B, so that it is always in contact with the upper surface 53Ba of the lower engaging piece 53B and the lower surface 54Ba of the upper engaging piece 54B. The actions between the black key 40 and the mass body 50B and the operations thereof during player's performance are the same as those between the white key 20 and the mass body 50W.

With this arrangement of the present embodiment, the mass bodies 50 and the key unit KU are assembled to the key frame 10 in the following manner: First, the bearing 51 of a mass body 50 is fitted on the associated pivot 14 from the front side. The same assembly operation is carried out for all the mass bodies 50.

On the other hand, a required number of key units KU (each for one octave) are formed separately in advance. Then, the key units are moved rearward from the front side to bring all the resilient members 31 of the key units KU into contact with the lower engaging pieces 53 (the upper surfaces 53Wa and 53Wb thereof) of the respective associated mass bodies 50. Then, the key units KU are further moved rearward to simultaneously bring all the resilient members 31 into fitting engagement between the lower engaging pieces 53 and the upper engaging pieces 54 (fitting recesses 55) of the respective associated mass bodies (see FIGS. 2 and 3).

On the other hand, in parallel with the engaging operation of the resilient members 31 with the fitting recesses 55, the respective guided parts 33 of the white keys 20 of the key unit KU naturally come into engagement with the associated key guides 12 of the key frame 10. Then, the common base end part 30 of the key unit KU is fastened to the key frame 10 by screws 82 (see FIG. 1). The other key units are assembled to the key frame 10 in the same manner.

Figure 6A:
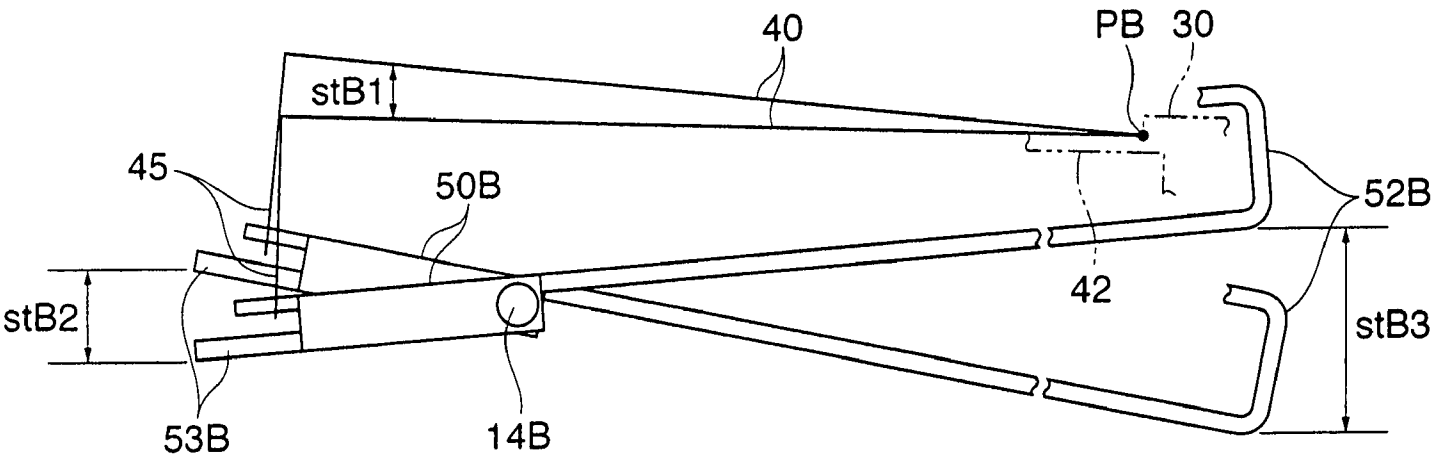
FIG. 6A is a schematic diagram of ranges of pivotal motions of a black key and a mass body.
Figure 6B:
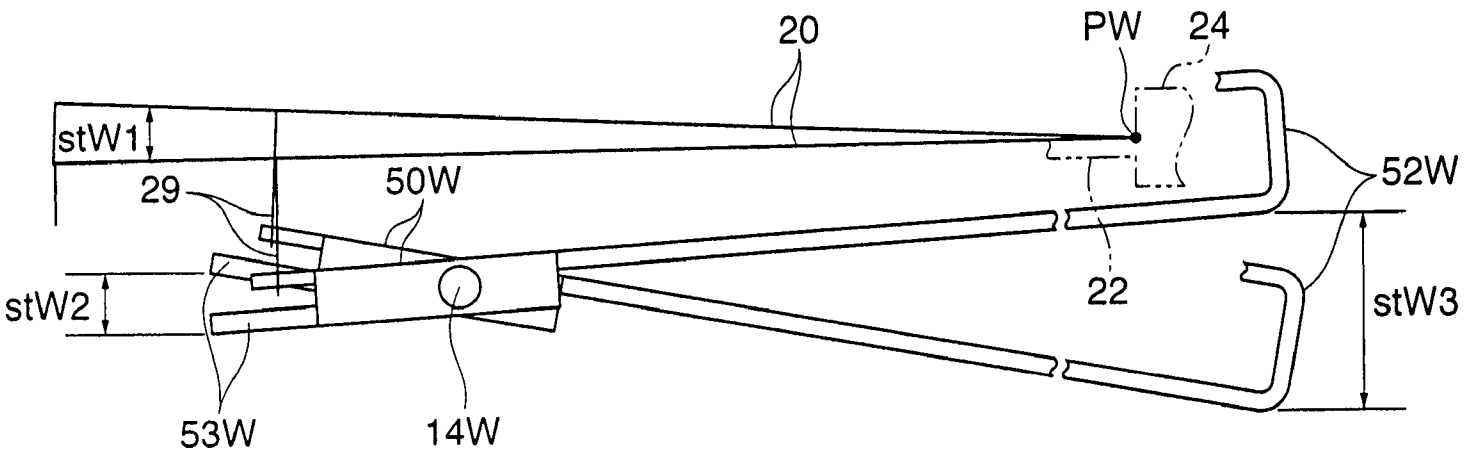
FIG. 6B is a schematic diagram of ranges of pivotal motions of a white key and a mass body.

In the completed keyboard apparatus 1, the white keys 20, the black keys 40, and the mass bodies 50W and 50B pivotally move through the following ranges: FIG. 6A is a schematic diagram of respective ranges of pivotal motions of the black key 40 and the mass body 50B, and FIG. 6B is a schematic diagram of respective ranges of pivotal motions of the white key 20 and the mass body 50W.

First, as described hereinabove, the lower engaging piece 53W and the lower engaging piece 53B are at the same longitudinal location. Further, the mass bodies 50W and 50B are configured to have the same length, and the rear ends 52W and 52B of the mass bodies 50W and 50B are also at the same longitudinal location. However, as described hereinabove, the pivots 14W and 14B are located at respective different longitudinal locations, such that the pivot 14B is rearward of the pivot 14W. In this connection, the connecting points PW and PB are also located at respective different longitudinal locations, such that the connecting point PB is slightly rearward of the connecting point PW.

In the positional relationship described above, the respective ranges of rotations of the mass bodies 50W and 50B are limited by the upper limit stopper 83 and the lower limit stopper 84, whereby the strokes of portions mentioned below, i.e. lengths over which the portions can travel, are as follows: First, assuming that the strokes of vertical motions of the rear ends 52W and 52B are represented by stW3 and stB3, the strokes of vertical motions of the lower engaging pieces 53W and 53B by stW2 and stB2, and the strokes of vertical motions (key depression strokes) of the white key 20 and the black key 40 in a region where depression of these keys often occurs by stW1 and stB1. The relationship in magnitude between the above-mentioned strokes are as follows: stW3=stB3, stW2<stW2, stW1=stB1.

Here, when discussing stW3 and stB3, it is assumed that the rear ends 52W and 52B as free ends are located at or rearward of points of contact of the mass bodies 50W and 50B again the upper limit stopper 83 and the lower limit stopper 84. Strictly, stW3 and stB3 represent respective strokes of longitudinal travels of predetermined portions (predetermined points) of the rear ends 52W and 52B. Alternatively, stW3 and stB3 may be defined as representing longitudinal distances between the points of contact of the rear ends 52W and 52B against the upper limit stopper 83, and the points of contact of the rear ends 52W and 52B against the lower limit stopper 84.

Since stW1=stB1 holds, the key depression strokes of the white key 20 and the black key 40 are equal to each other and balanced. What is more, since stW3=stB3 holds, the touch weights of these keys sensed during respective depressions thereof are also balanced. The longitudinal location of the region wherein the depressing operation is often performed is originally different between the white key 20 and the black key 40. However, by locating the pivot 14B rearward of the pivot 14W, and at the same time setting the distance between the lower engaging piece 53 and the pivot 14 such that the distance between those associated with the black key 40 is longer than the distance between those associated with the white key 20, the white key 20 and the black key 40 are properly balanced in respect of the touch feeling (stroke and touch weight).

According to the present embodiment, it is possible to secure excellent balance in touch feeling between the white key 20 and the black key 40. What is more, since the key depression strokes are made equal to each other, and the strokes stW3 and stB3 of motions of the rear ends 52 of the mass bodies 50 are made equal to each other, thereby making the key touch balanced between the white key 20 and the black key 40, it is possible to cause the touch feeling to match between the white key 20 and the black key 40. Further, since the mass bodies 50W and 50B have the same total length, and the locations of the front ends (lower engaging pieces 53W and 53B) and the locations of the rear ends 52W and 52B) coincide with each other, wasteful space is more difficult to be produced in the longitudinal direction in a region within the keyboard apparatus where the mass bodies 50 are arranged, compared with the arrangement in which the white key and the black key are made balanced in touch feeling by making them different in total length. This makes it possible to make the keyboard apparatus compact in size in the longitudinal direction.

Further, according to the present embodiment, the mass body-supporting ribs 13B are located rearward of the mass body-supporting ribs 13W, so that there is little overlap in the longitudinal direction between them (see FIGS. 4 and 5). The mold for integrally forming the mass body-supporting ribs 13 with the key frame 10 by injection molding is required to be provided with thin protruding pieces each corresponding to spacing between the mass body-supporting ribs 13W and 13B adjacent to each other. Assuming that the mass body-supporting ribs 13W and 13B overlap along a wide range of area, the range of area to be provided with the thin protruding pieces increases, which lowers the strength of the mold. The mass body-supporting ribs 13W and 13B are often adjacent to each other due to the key arrangement of the apparatus, and hence in the present embodiment, the area of overlap of these ribs 13W and 13B is reduced, whereby the range of area required for provision of the thin protruding pieces is reduced, so that the strength of the mold can be increased. Incidentally, when attention is paid to the mass body-supporting ribs 13 of each key, there is no provision of more than two successive mass body-supporting ribs 13W or mass body-supporting ribs 13B, and hence the longitudinal locations of respective adjacent mass body-supporting ribs 13 of adjacent keys are necessarily different on at least one of the left and right side of each key. This contributes to increased strength of portions of the mold for forming the two types of mass body-supporting ribs 13.

Further, the pivot 14B is located rearward of the pivot 14W, and the two do not overlap in the longitudinal direction, which makes it easier to avoid mutual interference between the pivots 14 in the transverse (left-right) direction, whereby the degree of freedom of design of the pivot 14 can be enhanced. More specifically, it is not too much to say that in general, a pivotal motion support, as exemplified by the pivot 14, for supporting the mass body or the like which performs pivotal motion according to the key depressing operation, receives all the forces acting during each performance operation, and hence is required to be high in strength and durability, so that the size of such a pivotal motion support naturally tends to be increased. According to the present embodiment, however, when attention is paid to each pivot 14, the longitudinal locations of adjacent pivots are necessarily different at least on one of the right and left sides of each key and hence space is produced toward the adjacent pivot which is different in the longitudinal location. Therefore, it is possible to adopt a design in which the support mechanism protrudes into the space toward the adjacent pivot, which enhances the degree of freedom of design.

It should be noted that from the viewpoint of properly securing the balance in touch feeling between the white key 20 and the black key 40, the longitudinal location of the lower engaging piece 53 and the distance between the lower engaging piece 53 and the pivot 14 need not be necessarily completely identical between the corresponding locations and distances of the white key 20 and the black key 40, but they are only required to be approximately identical. The motion strokes stW3 and stB3, and the key depression strokes stW1 and stB1 also need not be completely equal to each other.

To increase the strength of the mold, the rotary member supported by the pivotal motion support, such as the pivot 14, is not limited to the mass body 50. More specifically, any suitable pivotal member will suffice insofar as it is a pivotal member that pivots about the pivotal motion support according to the key depressing operation, and the pivotal member may be a key itself, or a member which is located between the key and the mass body 50 for pivotal motion. Therefore, the mass body-supporting ribs 13 as well are not necessarily required to be provided for the mass body 50, but any rib-like members will do insofar as they are formed integrally with the key frame for supporting such pivotal members as mentioned above.

To further increase the strength of the mold, it is preferred that there is no overlap between the mass body-supporting ribs 13W and the mass body-supporting ribs 13B.

Now, a description will be given of a second embodiment of the present invention with reference to FIGS. 7 to 8B.

In the first embodiment, the pivots 14W and 14B are made different in the longitudinal location. In the second embodiment, in addition thereto, the location of the pivot 14W and the location of the pivot 14B are progressively varied according to the tone pitch corresponding to each key.

Figure 7:
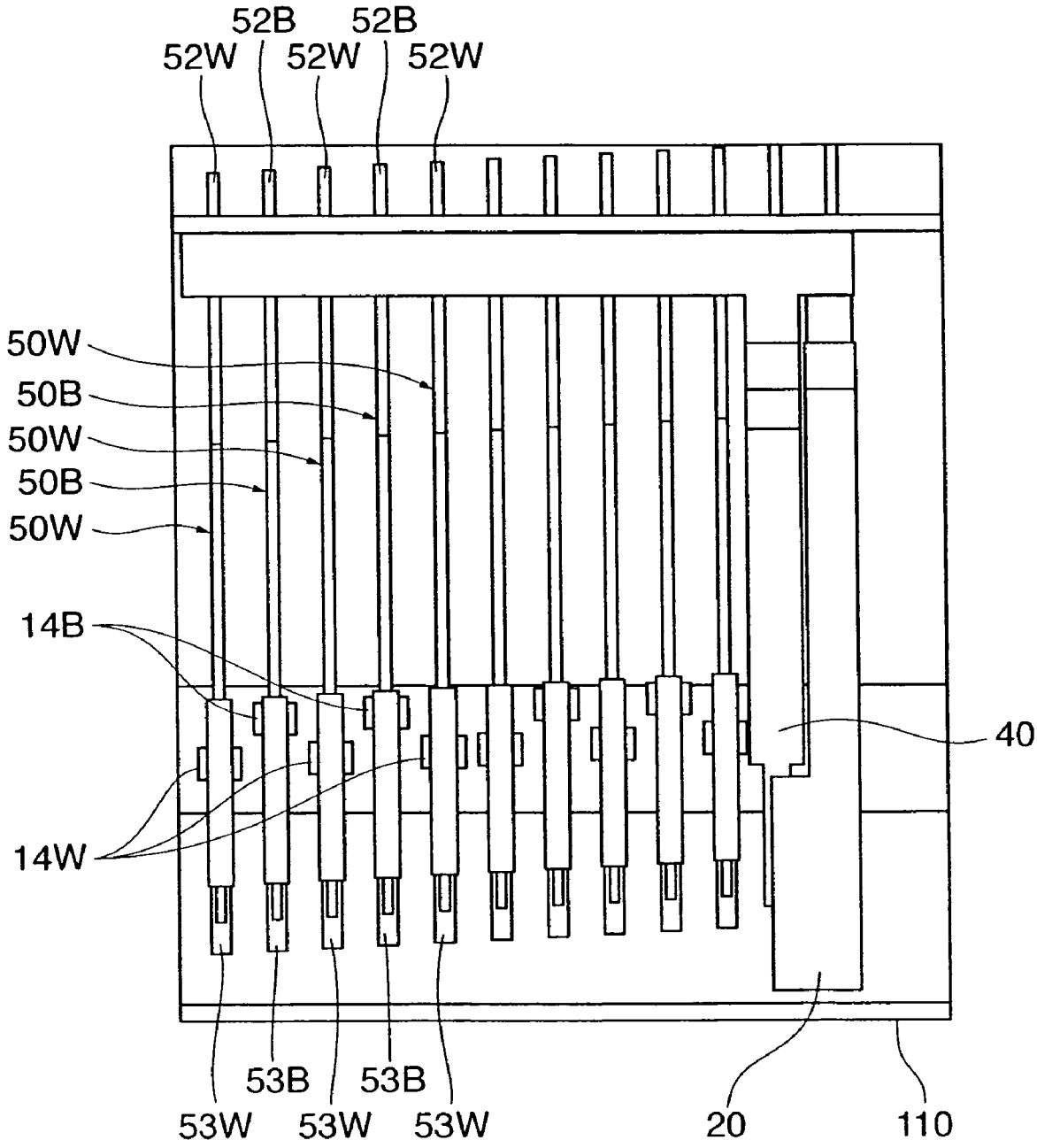
FIG. 7 is a fragmentary schematic plan view of a keyboard apparatus according to a second embodiment of the present invention.
Figure 8A:
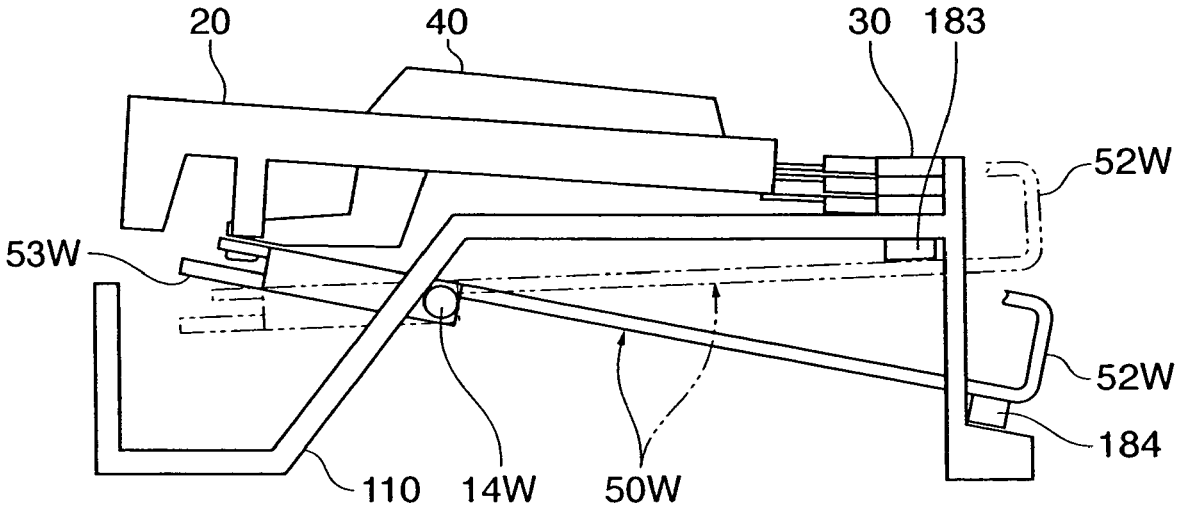
FIG. 8A is a schematic side view of the key frame to which are assembled mass bodies.

FIG. 7 is a fragmentary schematic plan view of a keyboard apparatus according to the second embodiment of the present invention, in a state in which mass bodies are assembled to a key frame. FIG. 8A is a schematic side view of the key frame to which are assembled the mass bodies, and FIG. 8B is a schematic rear view of the same.

As shown in FIG. 7, the longitudinal locations of the pivots 14W and 14B are progressively shifted rearward as the associated keys are for higher pitch tones. Therefore, as the white key 20 and the black key 40 are for higher pitch tones, they are lighter in key touch. In spite of this, the positional relationship between the pivot 14W and the pivot 14B is basically the same as that in the first embodiment, and the pivot 14B is located rearward of the pivot 14W. Therefore, the black key 40 is lighter in key touch, and hence balanced with the white key 20 in the touch weight. Incidentally, when comparison is made between the pivot 14W of a key for a higher pitch tone and the pivot 14B of a key for a lower pitch tone, the longitudinal location is sometimes inverted. However, at least considering the positional relationship between two pivots 14W and 14B adjacent to each other, the pivot 14B is located more rearward than the pivot 14W, so that there is no odd feeling as to the touch weigh which varies with the tone pitch.

The key frame 110 is distinguished from the key frame 10 only in that the locations of the mass body-supporting ribs 13W and 13B, not shown, progressively vary in accordance with the locations of the pivots 14W and 14B which progressively vary with the tone pitch, but is constructed similarly to the same in the other respects. Further, the mass bodies 50W and 50B themselves have the same constructions as those in the first embodiment, respectively and the longitudinal locations thereof vary with the locations of the pivots 14W and 14B. Therefore, the locations of the lower engaging pieces 53W and 53B and rear ends 52W and 52B are also different from those in the first embodiment, depending on the arrangement of the mass bodies 50W and 50B. Further, the key unit KU is different from that of the first embodiment in that the locations of the hanging driving pieces 29 and 45 and the location of the resilient member 31, none of which are shown, are different in accordance with different locations of the lower engaging pieces 53W and 53B of the mass bodies 50W and 50B, but is constructed similarly in the other respects.

By the way, although the key touch is configured to be made lighter as the key is for a higher pitch tone, assuming that the movable range of the rear end 52 of the mass body 50 is identical for all the mass bodies 50, the key depression stroke is made shorter as the key is for a lower pitch tone. Therefore, in the present embodiment, in place of the upper limit stopper 83 and the lower limit stopper 84 which are at respective uniform levels in the first embodiment, the key frame 110 is provided with upper limit stoppers 183 and lower limit stoppers 184 which vary in level from one mass body 50 to another, as shown in FIGS. 8A and 8B.

Figure 8B:
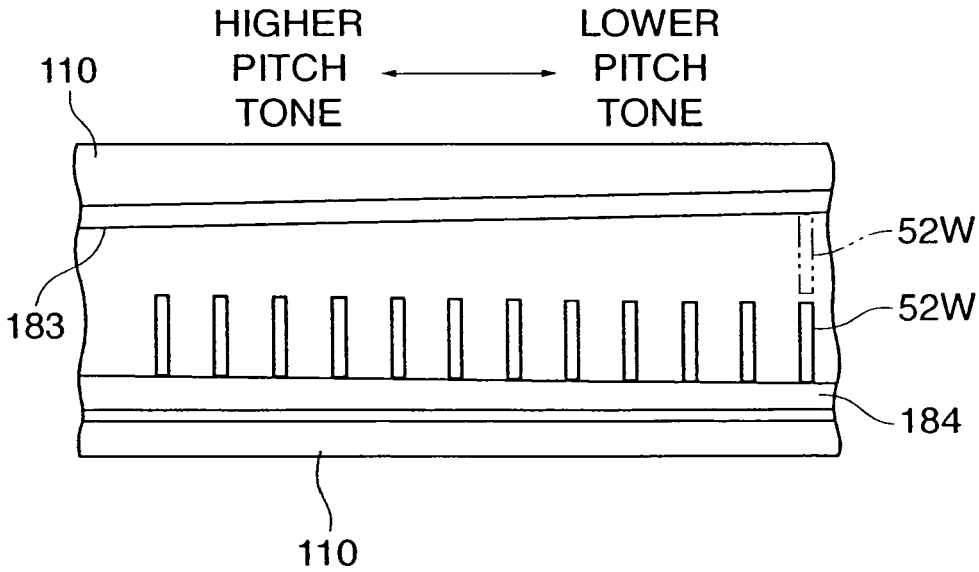
FIG. 8B is a schematic rear view of the key frame in the same state as shown in FIG. 8A.

As shown in FIG. 8B, the bottom surface of the lower limit stopper 183 is higher as the associated key is for a lower pitch tone, and the top surface of the lower limit stopper 184 is lower as the associated key is for a lower pitch tone. More specifically, as the key is for a lower pitch tone, the distance between the upper limit stopper 183 and the associated lower limit stopper 184 becomes larger, and hence the stroke of motion of the rear end 52 of the mass body 50 is longer as the associated key is for a lower pitch tone. With this arrangement, the key depression stroke in a region where the white key 20 and the black key 40 are depressed very frequently is made uniform for all the keys.

By the way, if the keys in the entire frequency range are continuously subjected to the aforementioned progressive variation in the locations of the pivots 14W and 14B according to the tone pitch, the longitudinal length of the keyboard apparatus 1 becomes too large. To overcome the problem, the aforementioned progressive variation is repeated for each frequency range (one octave) corresponding to the key unit KU and at the same time grade (mass) of the used mass bodies 50 is made different from one frequency range to another. For example, in a second frequency range higher than a first frequency range by one frequency range, the grade of the mass bodies 50 is lowered (made lighter) by one stage, and the progressive variation pattern of the pivot 14 in the longitudinal direction is made identical to that in the first frequency range. Therefore, the leftmost pivots 14 in the respective frequency ranges are at the same longitudinal location. It should be noted that the progressive variation pattern is not necessarily required to be repeated for each frequency range corresponding to the key unit KU, but may be repeated on a several octaves-by-several octaves basis, or on a several keys-by-several keys basis.

The present embodiment provides the same advantageous effects as provided by the first embodiment in that the touch feeling is well balanced between the white key 20 and the black key 40, and at the same time the keyboard apparatus 1 is made compact in size in the longitudinal direction of the apparatus. Furthermore, it is possible to easily realize key scaling of the touch weight (progressive variation in the touch weight according to the pitch). What is more, the distance between the upper limit stopper 183 and the lower limit stopper 184 is varied with the tone pitch, whereby the stroke of key depression is made uniform between the white keys 20 and between the black keys 40. This makes the touch feeling of a depressed key appropriate according to the tone pitch. These can be made possible without making the mass bodies 50 different on a key-by-key basis, and hence the key scaling of all keys is made possible with a smaller number of types of mass bodies 50.

In the second embodiment, only from the viewpoint of realizing the key scaling dependent on the touch weight, the lower engaging pieces 53 of all the mass bodies 50 may be at the same longitudinal location, and at the same time the mass bodies 50W and 50B may be made longer in the distance between the lower engaging piece 53 and the pivot 14 as they are associated with keys for higher pitch tones.

Although in the first and second embodiments, the lower engaging piece 53 of the mass body 50 is located forward of the pivot 14 by way of example, this is not limitative, but the orientation of the mass body 50 may be inverted in the longitudinal direction, and the free end may be directed frontward, differently from the above-described embodiments. In this case, it goes without saying that the positional relationship between the lower engaging piece 53 and the pivot 14 of each mass body 50 is inverted, but also between the mass bodies 50W and 50B, the positional relationship between the pivots 14W and 14B and that between the lower engaging pieces 53W and 53B are also inverted in the longitudinal direction.

Although in the first and second embodiments, the key units KU each integrating a plurality keys therein are used, this is not limitative, but keys may be provided separately or independently of each other.

What is claimed is:

1. A keyboard apparatus comprising:

a support member;

a plurality of keys each having a driving part, and disposed on said support member such that each key is pivotally movable about a base end part thereof, said keys comprising a plurality of white keys and a plurality of black keys;

a plurality of pivotal motion supports fixedly provided on said support member; and a plurality of mass bodies provided in a manner respectively associated with said pivotal motion supports, and each having a driven part, said mass bodies being disposed in a manner pivotally movable about respective associated ones of said pivotal motion supports, and comprising white key-associated mass bodies that are associated with said white keys, respectively, and black key-associated mass bodies that are associated with said black keys, respectively, wherein said driving part of each key drives said driven part of an associated one of said mass bodies, in accordance with pivotal motion of said key, whereby said associated mass body pivotally moves about said associated pivotal motion support, and wherein said driven part of each white key-associated mass body and said driven part of each black key-associated mass body are at the same longitudinal location, and at the same time a distance between said driven part of said black key-associated mass body and said pivotal motion support associated therewith is longer than a distance between said driven part of said white key-associated mass body and said pivotal motion support associated therewith.

2. A keyboard apparatus as claimed in claim 1, comprising pivotal motion range-limiting parts for limiting a range of pivotal motion of each of said mass bodies, and wherein a distance through which a free end of each mass body moves in accordance with the pivotal motion of said mass body is made substantially equal between said white key-associated mass bodies and said black key-associated mass bodies.

3. A keyboard apparatus comprising:

a support member;

a plurality of keys each having a driving part, and disposed on said support member such that each key is pivotally movable about a base end part thereof, said keys comprising a plurality of white keys and a plurality of black keys;

a plurality of pivotal motion supports fixedly provided on said support member; and a plurality of mass bodies provided in a manner respectively associated with said pivotal motion supports, and each having a driven part, said mass bodies being disposed in a manner pivotally movable about respective associated ones of said pivotal motion supports, and comprising white key-associated mass bodies that are associated with said white keys, respectively, and black key-associated mass bodies that are associated with said black keys, respectively, wherein said driving part of each key drives said driven part of an associated one of said mass bodies, in accordance with pivotal motion of said key, whereby said associated mass body pivotally moves about said associated pivotal motion support, wherein said pivotal motion support of each of said mass bodies is located toward one side in the longitudinal direction with respect to said driven part, wherein said pivotal motion support is disposed toward the one side in the longitudinal direction, for said black key-associated mass bodies than for said white key-associated mass bodies, and wherein as to each of said white key-associated mass bodies and said black key-associated mass bodies, said pivotal motion support of said mass body is located more toward the one side in the longitudinal direction as said mass body is of a key for a higher pitch tone, such that touch feeling of the key becomes progressively lighter from a lower pitch tone side to a higher pitch tone side.

4. A keyboard apparatus as claimed in claim 1, comprising pivotal motion range-limiting parts for limiting a range of pivotal motion of each of said mass bodies, and said pivotal motion range-limiting parts limit the range of pivotal motion of each of said white key-associated mass bodies and said black key-associated mass bodies, such that a distance through which a free end of each mass body moves in accordance with the pivotal motion of said mass body is made smaller for said mass body on a higher pitch tone side.

5. A keyboard apparatus comprising:

a support member made of a resin;

a plurality of support providing parts formed integrally with said support member and having a rib-like shape extending in a longitudinal direction and a vertical direction;

a plurality of pivotal motion supports associated with said support providing parts, respectively, and each fixedly arranged at respective associated ones of said support providing parts; and a plurality of rotary members disposed in a manner associated with said pivotal motion supports, respectively, each for pivotally moving about an associated one of said pivotal motion supports in accordance with key depressing operation, wherein said support providing part associated with each rotary member and said support providing part associated with one of said rotary members adjacent to said rotary member at least on one of left and right sides thereof are disposed at different locations in the longitudinal direction.

6. A keyboard apparatus as claimed in claim 5, wherein said pivotal motion support associated with each rotary member, and said pivotal motion support associated with one of said rotary members adjacent to said rotary member at least on one of left and right sides thereof are disposed at different locations in the longitudinal direction.

7. A keyboard apparatus as claimed in claim 5, wherein said rotary members each have a driven part, and are a plurality of mass bodies comprising white key-associated mass bodies that each pivotally move in accordance with a key depressing operation of an associated white key and black key-associated mass bodies that each pivotally move in accordance with a key depressing operation of an associated black key, said driven part of each mass body being configured to perform pivotal motion in accordance with driving of said driven part by the associated key, and wherein said pivotal motion support of each mass body is located on one side of said driven part in the longitudinal direction, and said pivotal motion supports respectively associated with said black key-associated mass bodies are located more toward the one side in the longitudinal direction than said pivotal motion support respectively associated with said white key-associated mass bodies.

8. A keyboard apparatus as claimed in claim 5, wherein said rotary members each have a driven part, and are a plurality of mass bodies comprising white key-associated mass bodies that each pivotally move in accordance with a key depressing operation of an associated white key and black key-associated mass bodies that each pivotally move in accordance with a key depressing operation of an associated black key, said driven part of each mass body being configured to perform pivotal motion in accordance with driving of said driven part by the associated key, and wherein said support providing parts associated with respective white key-associated mass bodies are different in longitudinal location from said support providing parts associated with said respective black key-associated mass bodies, respectively.

* * * * *